US011840777B2

(12) United States Patent
Debuf et al.

(10) Patent No.: US 11,840,777 B2
(45) Date of Patent: Dec. 12, 2023

(54) WEAVING MACHINE WITH DEVICE AND METHOD FOR DETECTING VARIATIONS IN PILE-FORMING

(71) Applicant: VANDEWIELE NV, Kortrijk/Marke (BE)

(72) Inventors: Geert Debuf, Drongen (BE); Bram Vanderjeugt, Ypres (BE)

(73) Assignee: VANDEWIELE NV, Kortrijk/Marke (BE)

( * ) Notice: Subject to any disclaimer, the term of this patent is extended or adjusted under 35 U.S.C. 154(b) by 228 days.

(21) Appl. No.: 17/620,090

(22) PCT Filed: Jun. 19, 2020

(86) PCT No.: PCT/IB2020/055776
§ 371 (c)(1),
(2) Date: Dec. 16, 2021

(87) PCT Pub. No.: WO2020/255056
PCT Pub. Date: Dec. 24, 2020

(65) Prior Publication Data

US 2022/0316106 A1 Oct. 6, 2022

(30) Foreign Application Priority Data

Jun. 20, 2019 (BE) ..... 2019/5400

(51) Int. Cl.
*D03D 39/00* (2006.01)
*D03D 49/12* (2006.01)
(Continued)

(52) U.S. Cl.
CPC ..... *D03D 39/00* (2013.01); *D03D 47/18* (2013.01); *D03D 49/12* (2013.01); *D03D 51/28* (2013.01); *D03J 1/00* (2013.01); *D03J 2700/06* (2013.01)

(58) Field of Classification Search
CPC ..... D03D 39/00; D03D 47/18; D03D 49/12; D03D 51/28; D03D 49/06; D03J 1/00; D03J 2700/06
See application file for complete search history.

(56) References Cited

U.S. PATENT DOCUMENTS 4,752,044 A * 6/1988 Memminger ..... D04B 15/50 66/146
5,002,095 A * 3/1991 Herrin ..... D03D 39/223 139/105

(Continued)

FOREIGN PATENT DOCUMENTS

EP 0224464 A2 6/1987

*Primary Examiner* — Robert H Muromoto, Jr.
(74) *Attorney, Agent, or Firm* — FRESH IP PLC; Clifford D. Hyra; Aubrey Y. Chen

(57) ABSTRACT

Disclosed is a weaving machine, including:
- a yarn tensioning system for keeping a pile-warp yarn under tension, including a local control unit, a drive motor Wand a drive roller; and
- a detection device for detecting abnormal variations in the pile-forming, including:
  - a measuring system, for measuring, with the aid of the drive motor and the drive roller, pile-warp yarn consumption $x_m$ of the pile-warp yarn per cycle unit of one or more weft insertion cycles;
  - a reference system, for determining for each cycle unit whether the pile-warp yarn is interlaced in a figure-forming manner and for determining the expected pile-warp yarn consumption $x_t$; and
  - a computing system, for comparing the measured with the expected pile-warp yarn consumption when the pile-warp yarn is interlaced in a figure-forming manner, and for detecting, on the basis of this comparison, abnormal variations.

(Continued)

In addition, disclosed is an associated method for detecting abnormal variations in pile-forming in a weaving machine.

12 Claims, 4 Drawing Sheets

(51) Int. Cl.

| | |
|---|---|
| ***D03D 47/18*** | (2006.01) |
| ***D03D 51/28*** | (2006.01) |
| ***D03J 1/00*** | (2006.01) |

(56) References Cited

U.S. PATENT DOCUMENTS

| | | | | |
|---|---|---|---|---|
| 8,305,015 | B2 * | 11/2012 | Barea | B65H 59/18 318/661 |
| 9,499,926 | B2 * | 11/2016 | Cohen | D03J 1/007 |
| 10,859,454 | B2 * | 12/2020 | Debuf | D03D 49/12 |
| 2014/0036061 | A1 * | 2/2014 | Cohen | D03J 1/007 348/92 |
| 2022/0228302 | A1 * | 7/2022 | Debuf | D03D 49/14 |

* cited by examiner

WEAVING MACHINE WITH DEVICE AND METHOD FOR DETECTING VARIATIONS IN PILE-FORMING

FIELD OF THE DISCLOSURE

The present disclosure relates to a detection device and a method for detecting abnormal variations in pile-forming in a weaving machine, in which, in successive weft insertion cycles, at least one weft yarn is inserted between ground warp yarns so as to form a ground fabric together, and pile-warp yarns are interlaced according to a predefined weave pattern into the ground fabric in a figure-forming manner, or are incorporated in a non-figure-forming manner.

Also included under fabrics with pile-forming are, for example, ribbed fabric and sisal fabric.

BACKGROUND

In the present-day weaving machines, abnormal variations are often only detected in a woven carpet, wherein it is too late to correct faults which hereby arise in the carpet. Such a carpet then gets assigned a lower quality.

Some abnormal variations are the result of faults in the Jacquard, which can be detected with the aid of detection systems built into the Jacquard. A whole host of abnormal variations remain herewith undetected, however.

In US 2014/0036061 A1, a camera detection system for detecting variations in the shed is described. As a result of the large quantity of yarns which can also be found one in front of another, it is difficult to accurately determine variations. In this context, focus is easily directed at the shed, whereby variations outside this shed remain undetected.

In EP 0 244 464 A2 is provided a measuring device, having a running wheel on which the pile-warp yarn to be woven is conducted, and a disc, which turns synchronously with that running wheel and which, together with a photoelectric cell, acts as a pulse counter, and couples means for checking the information provided by this pulse counter, by means of a clock for each pile-warp yarn to be checked, to an electronic memory, with which the pile-warp yarn consumption of a pile-warp yarn is measured. This pile-warp yarn consumption is then compared in a processor with a reference value in order to detect variations. The device with which abnormal variations are in this way detected is here of very complex and bulky design.

SUMMARY

The object of the present disclosure is to provide a simplified, compact device and a method for detecting variations in pile-forming in a weaving machine, which can supplement the known detection methods in order to be able to detect and rectify more faults at any early stage.

This object of the disclosure is achieved by providing a weaving machine in which, in successive weft insertion cycles, at least one weft yarn is inserted between ground warp yarns so as to form a ground fabric together, and pile-warp yarns are interlaced according to a predefined weave pattern into the ground fabric in a figure-forming manner, or are incorporated in a non-figure-forming manner, comprising:

- a yarn tensioning system for keeping at least one pile-warp yarn under tension, wherein this yarn tensioning system:
  - comprises a local control unit;
  - comprises a drive motor; and
  - comprises a drive roller, wherein the drive motor is controllable with the local control unit for the driving of the drive roller in order to feed the at least one pile-warp yarn and keep it under tension;
- and a detection device, for detecting abnormal variations in pile-forming, wherein this detection device:
  - comprises a measuring system, which is provided for measuring pile-warp yarn consumption $x_m$ of the at least one pile-warp yarn, per cycle unit of one or more weft insertion cycles, with the aid of the drive motor and the local control unit, wherein the drive motor and the local control unit, for this purpose, form part of the measuring system;
  - comprises a reference system, for determining on the basis of the predefined weave pattern, for each cycle unit, whether the at least one pile-warp yarn is interlaced in a figure-forming manner, and for determining the expected pile-warp yarn consumption $x_t$ for the at least one pile-warp yarn; and
  - comprises a computing system, for comparing, for each cycle unit, the measured pile-warp yarn consumption $x_m$ with the expected pile-warp yarn consumption $x_t$, when the at least one pile-warp yarn is interlaced in this cycle unit in a figure-forming manner, and for, on the basis of this comparison, detecting abnormal variations.

With the aid of a detection device according to this disclosure, various problems can be detected at an early stage.

The pile-warp yarn consumption is measured with a simple and compact measuring device.

Because the pile-warp yarn consumption can be rigorously detected, also two pile-loop fabrics can now, for example, be woven one above the other, whereby the customary visual inspection becomes redundant.

Possible reasons for a different pile-warp yarn consumption are, for example:

1. An incorrect harness draw, when pile-warp yarns have not been drawn through the correct heddles. Two pile-warp yarns have swapped places, for example. This leads to faults in the woven carpet. In the event of an early detection, virtually directly after the occurrence of the fault (and not when the fault is visible in the carpet), this fault can be immediately repaired and there are no wrongly woven carpets.
2. An incorrect shed setting (too large a shed or too small a shed, but still sufficiently large to allow the rapier to pass through). This produces a difference in momentary consumption, but leads to a nett equal pile-warp yarn consumption in the long term, so that faults in the carpet do not really arise. However, there is more pile requested and more pile recuperated, which is to be avoided.
3. A return spring which is broken. This ensures that the heddle no longer selects correctly, in other words the heddle eye is no longer placed at the desired height. The sole downward force to which the heddle is still subjected is the downward force exerted by the yarn tension (and which is only exerted when the yarn tension draws the heddle downwards—thus in the uppermost part of the shed—to the point when the yarn runs stretched through the heddle eye). Faults in the selection of the Jacquard lead to faults in the carpet. In the event of early detection, this can be immediately repaired without the fault having to be discovered in the already woven carpet.

4. Problems in respect of the Jacquard. Such problems can also lead to a wrong selection, which gives rise to a heddle eye that is not positioned at the desired position, resulting in faults in the carpet (for example variations in the drawing). Such faults in the carpet are now sometimes only discovered upon visual inspection of the already woven carpet.
5. Dust accumulation. The spring can hereby be blocked. This has similar consequences as in point 3. The harness cord can also more or less get stuck in the harness board. Both cases result in the heddle eye with the warp yarn not being positioned at the desired height. Generally, dust accumulation has more influence on the movement downwards than on the movement upwards.
6. Heddles or yarns which remain stuck or get caught on other heddles or yarns. This also ensures a wrong positioning of the heddle eye in the shed. They take the position of the heddles or yarns to which they have "riveted". This also ensures faults in the woven carpet.
7. Differences of tension in the ground warp yarns, especially in the tension warp. In the event of a poorly made beam, whereby the various tension warp yarns have a different yarn tension, as a result of the difference in tension the jaw is more or less pulled shut, whereby more or less pile is consumed. The obtained pile height in the carpet differs from the desired pile height and can, moreover, be variable over the total width of the carpet. When this happens, then the carpet has to be shorn in order to obtain everywhere the same pile height. Another consequence hereof is that the carpet often displays stripes, whereby it becomes a carpet of lesser quality.

The at least one pile-warp yarn will be a pile-warp yarn which is fed separately, or a group of pile-warp yarns which are fed simultaneously.

As the said cycle unit, a weft insertion cycle can be chosen. It is also possible, for example, to opt (for example in the case of a ½V weave structure) to follow the cycle of the Jacquard and to operate every 2 weft insertion cycles.

The pile-warp yarn consumption is dependent on the type of yarn, the average yarn tension, the set pile height, the position in the creel, etc. The expected pile-warp yarn consumption $x_t$ will accordingly be dependent on such factors.

The expected pile-warp yarn consumption $x_t$ can be determined, for example, on the basis of test measurements.

Today computing methods are also already known for computing, on the basis of the predefined weave pattern, the expected yarn consumption, in order, on the basis hereof, to do stock management. These computing methods can now be used to determine the expected pile-warp yarn consumption $x_t$ per cycle unit. On the basis of measurements of the actual pile-warp yarn consumption $x_m$, this theoretical computation can then possibly over time be modified in order to determine the expected pile-warp yarn consumption $x_t$ still more accurately.

In the measuring of the pile-warp yarn consumption, any yarn recuperation should also be taken into account, so that this consumption $x_m$, in the event of yarn recuperation, may also turn out to be negative.

A detection device according to this disclosure can possibly be supplemented by a visual inspection of the shed by means of cameras and image processing.

When, for example, the heddle eye is not positioned at the desired height, the danger exists that the heddle eye is positioned such that the pile-warp yarn is level with the passing rapier head and is thus taken along. In order to detect such problems, there can also be provided, for example, camera surveillance, which looks into the shed and detects this. A transported pile-warp yarn generally leads to breakage of the pile-warp yarn.

The weaving machine will typically comprise a central control unit for controlling the weaving machine in order to insert, in successive weft insertion cycles, at least one weft yarn between ground warp yarns so as to form a ground fabric together, and to interlace pile-warp yarns according to a predefined weave pattern into the ground fabric in a figure-forming manner, or to incorporate them in a non-figure-forming manner. Preferably, the weaving machine then comprises communication means for communicating between the central control unit and the local control unit whether the at least one pile-warp yarn is interlaced in a figure-forming manner, wherein the reference system makes use of these communication means to determine the expected pile-warp yarn consumption for the at least one pile-warp yarn.

The yarn tensioning system can, for each cycle unit, receive a pulse to start the measurement, this, for example, upon the beat-up of the reed (so that the method is performed per weft insertion cycle), or at the moment that the Jacquard makes its selection (so that the method is performed in every 2 weft insertion cycles).

Each yarn tensioning system can forward the pile-warp yarn consumption measured per cycle unit to a central control unit of the weaving machine, this together with its ID, where the measured pile-warp yarn consumption is compared with the expected pile-warp yarn consumption. Another possibility is that each yarn tensioning system gets the expected pile-warp yarn consumption (possibly together with other pattern information) sent into a local control unit thereof and itself makes the comparison.

For each drive roller, the length of the pile-warp yarns kept under tension by this drive roller can be computed, for example, from the number of revolutions of the drive roller or the angular rotation of the motor and the diameter of the drive roller. A yarn tensioning system can comprise one or more such drive motors and associated drive rollers. When a yarn tensioning system comprises a plurality of drive motors, a local control unit can be provided for each such drive motor, or per group of drive motors.

A detection device of a weaving machine according to the present disclosure further preferably also comprises signalling means for signalling detected abnormal variations.

Also a plurality of signalling means may here be provided in order to be able to generate differing signals for various sorts of detected abnormal variations.

These signalling means can be integrated, for example, in the measuring system. Thus a yarn tensioning system can be provided, for example, with LEDS as signalling means.

Alternatively or additionally, it is also possible, for example, to signal abnormal variations, for example, via the Jacquard of the weaving machine, or via a computer, or via smart wristbands, etc.

Further alternatively or additionally, the weaving machine, for example, can be stopped and hereupon placed, for example, in a specific position in which a possible fault is easier to rectify.

A detection device of a weaving machine according to the present disclosure further preferably comprises a storage system for storing abnormal variations and the time of occurrence of these abnormal variations.

In addition, the object of the present disclosure is achieved by providing a method for detecting abnormal variations in pile-forming in a weaving machine, in which, in successive weft insertion cycles, at least one weft yarn is inserted between ground warp yarns so as together to form a ground fabric, and pile-warp yarns are interlaced according to a predefined weave pattern into the ground fabric in a figure-forming manner, or are incorporated in a non-figure-forming manner, wherein this method, for each cycle unit of one or more weft insertion cycles, comprises the following steps:

a. measuring pile-warp yarn consumption $x_m$ of at least one pile-warp yarn;

b. determining on the basis of the predefined weave pattern whether the at least one pile-warp yarn is interlaced in a figure-forming manner, and determining the expected pile-warp yarn consumption $x_t$ for the at least one pile-warp yarn; and c. comparing the measured pile-warp yarn consumption $x_m$ with the expected pile-warp yarn consumption $x_t$, when the at least one pile-warp yarn is interlaced in a figure-forming manner, and detecting, on the basis of this comparison, abnormal variations.

In step c, the percentual variation $\Delta x_{\%}$ of the measured pile-warp yarn consumption $x_m$ relative to the expected pile-warp yarn consumption $x_t$ is preferably determined. Preferably, a signal is then generated when this percentual variation $\Delta x_{\%}$ exceeds an uppermost reference value $r_b$. Possibly, the weaving machine can here be stopped in order to repair a fault.

More specifically, when the percentual variation $\Delta x_{\%}$ remains below the uppermost reference value $r_b$ and exceeds a lowermost reference value $r_o$, this percentual variation $\Delta x_{\%}$ can be written as a small variation into a buffer, and when, for a specific time, a plurality of small variations are written into the buffer, a signal can be generated and the buffer can be emptied.

When the comparison takes place, as indicated above, in a local control unit, the uppermost reference value $r_b$ (and the possible lowermost reference value $r_o$), together with the expected pile-warp yarn consumption $x_t$, should be delivered to this local control unit. It is also possible, for example, that this local control unit comprises for this purpose a reference table of reference values, and that a code is issued, on the basis of which the local control unit can determine which reference value from this reference table should be used.

The uppermost reference value $r_b$ is chosen such that variations above this uppermost reference value typically indicate a major fault.

Any lowermost reference value $r_o$ is chosen such that variations below this said uppermost reference value $r_b$ but above a lowermost reference value $r_o$ are still labelled as abnormal. These then rather indicate a sub-optimal working of the weaving machine, but not a major fault. When, for a specific reference time, a plurality of such small variations arise, it can be worth checking and optimizing the working of the weaving machine.

On the basis of reference measurements or earlier measurements of pile-warp yarn consumption $x_m$, these reference values $r_b$, $r_o$ are able to be determined. Both the uppermost reference value $r_b$ and the lowermost reference value $r_o$ may vary depending on the expected yarn consumption in order thus to optimize the detection and the machine working. Thus these reference values $r_b$, $r_o$ can be determined in dependence on the pile height, cut pile, loop pile, the forming of floats, etc. The pile-warp yarn consumption in the forming of a float is, for example, significantly lower than in the forming of a pile.

In a preferred method according to the present disclosure, the uppermost reference value $r_b$, after a plurality of cycle units, is adapted as a function of the percentual variations $\Delta x_{\%}$ determined during the cycle units.

To this end, these percentual variations $\Delta x_{\%}$ are stored for a certain time in a buffer and, after this time, the possible necessary adaptation is determined and this buffer emptied.

Also any lowermost reference value $r_o$ is preferably adapted in a similar manner.

The object of the present disclosure is also achieved by providing a local control unit of a weaving machine according to the present disclosure, which is configured to control the detection device of this weaving machine according to an above-described method according to the present disclosure.

In addition, the object of the present disclosure is achieved by providing a central control unit of a weaving machine according to the present disclosure, which is configured to control the detection device of this weaving machine according to an above-described method according to the present disclosure.

The object of the present disclosure is also achieved with a computer program product, consisting of computer-readable code, which, when this code is executed on a local control unit according to the present disclosure, this produces the result that the local control unit controls the detection device of the weaving machine according to a method according to the present disclosure.

The object of the present disclosure is further achieved with a computer program product, consisting of computer-readable code, which, when this code is executed on a central control unit according to the present disclosure, this produces the result that the central control unit controls the detection device of the weaving machine according to a method according to the present disclosure.

Finally, the object of the present disclosure is achieved by providing a non-transient machine-readable storage medium, which stores a computer program product according to the present disclosure.

The present disclosure is now explained in greater detail below based on the hereafter following detailed description of embodiments of a device and a method according to the present disclosure. The aim of this description is solely to give illustrative examples and to indicate further advantages and particularities of the present disclosure, and can thus not be interpreted as limiting the field of application of the disclosure or the patent rights claimed in the claims.

BRIEF DESCRIPTION OF THE DRAWINGS

In this description, reference is made by means of reference numerals to the accompanying drawings, wherein in FIG. 1 a weaving machine is represented schematically.

DETAILED DESCRIPTION

Figure 1:
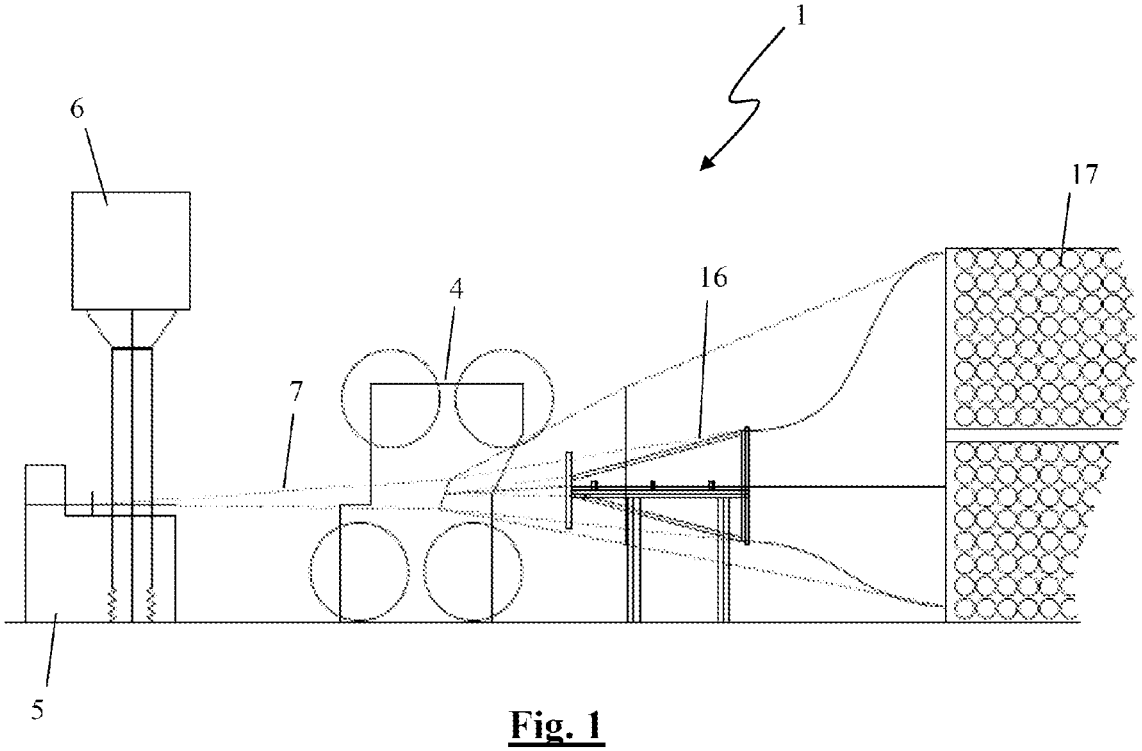

In FIG. 1, a face-to-face weaving machine (1) is depicted. The disclosure is, however, also applicable to single-face weaving machines.

With weaving machines (1) of this type, it is possible to realize fabrics with cut pile and/or loop pile, wherein the piles can assume various pile heights and wherein the position and height of differing pile heights can be chosen. To this end, a defined weave pattern is formed in advance.

The depicted weaving machine (1) comprises a bobbin creel (17) as the yarn storage system, a feed device (16) for feeding pile-warp yarns (7) from the bobbin creel (17), via the beam stand (4), to a weaving device (5). Above the weaving device (5) is arranged a Jacquard (6) for controlling, on the basis of the predefined weave pattern, the heddles with which the pile-warp yarns (7) are positioned.

With the aid of the weaving machine (1), an upper and a lower pile fabric can thus be formed in the weaving device (5) in a known manner by inserting weft yarns, in successive weft insertion cycles, between ground warp yarns, so as to form together two ground fabrics, and to interlace pile-warp yarns (7) according to the predefined weave pattern into these ground fabrics in a figure-forming manner, or to incorporate them in a non-figure-forming manner.

Figure 2A:
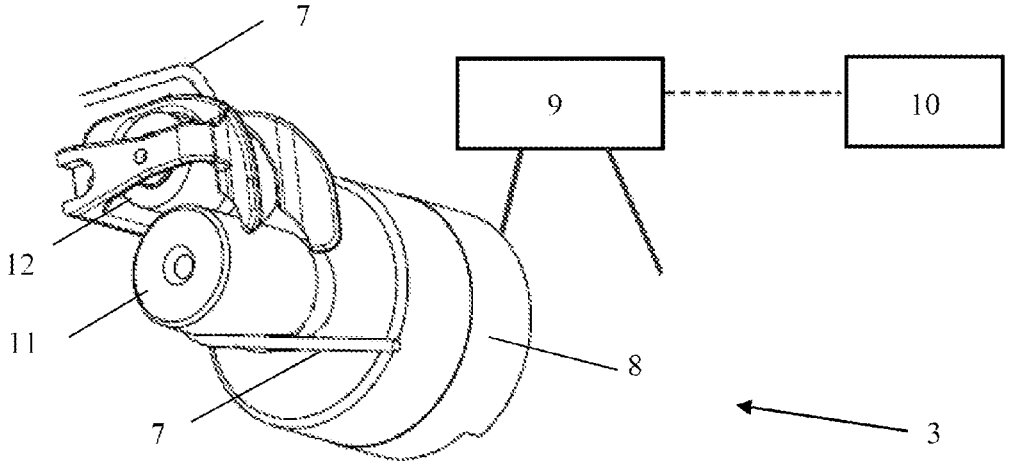
FIG. 2*a* a yarn-feeding module with an actuator is represented schematically.
Figure 2B:
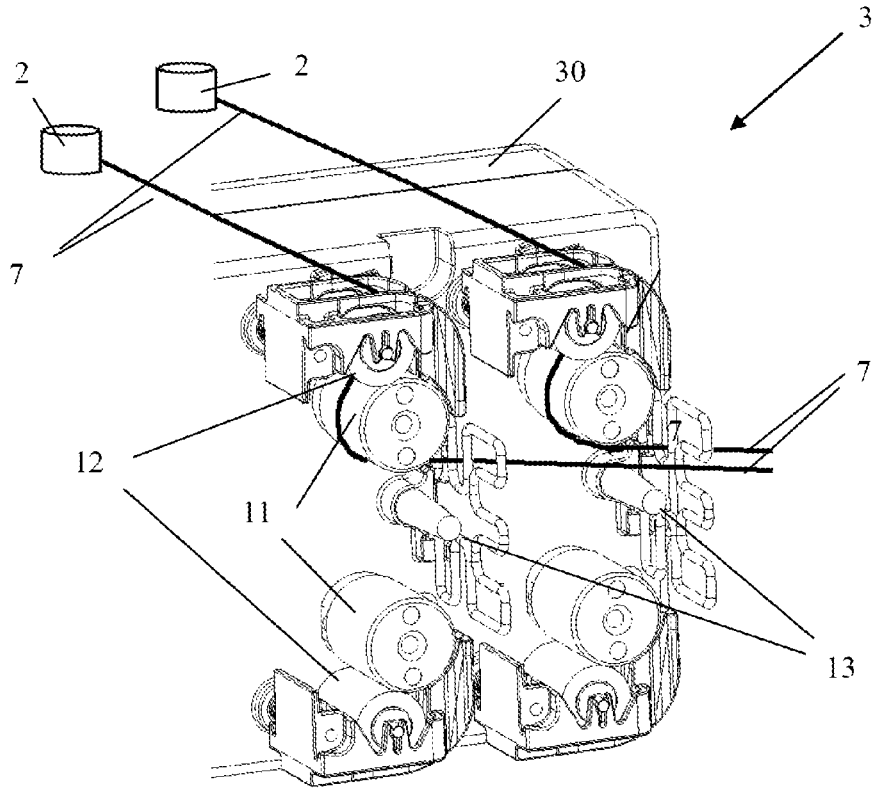
FIG. 2*b* a part of a yarn-feeding module of the feed device from the weaving machine from FIG. 1 is depicted in perspective, wherein four actuators are portrayed for the feeding of four yarns.

The feed device (16) comprises a plurality of yarn-feeding modules (3) as depicted in FIG. 2*b*, which likewise serve as a yarn tensioning system, such as described in WO 2017/077454 A1. The depicted yarn-feeding module (3) comprises, for the driving of drive rollers (11), four motors (8), which are typically located in the housing (30). With the aid of these drive rollers (11), the pile-warp yarns (7) of bobbins (2) are unwound from the bobbin creel (17) and fed to the weaving device (5). The pile-warp yarns (7) are in this case, however, depicted for only two drive rollers. These pile-warp yarns (7) are pressed against the drive rollers (11) with the aid of tension rollers (12).

In FIG. 2*a*, a yarn-feeding module having a motor (8) is depicted schematically, wherein the housing (30) has been omitted and the motor (8) is visible.

The yarn-feeding modules (3) further comprise a local control unit (9), which on the one hand is connected to the motors (8), and on the other hand is connected to the central control unit (10) of the weaving machine (1).

Figure 5:
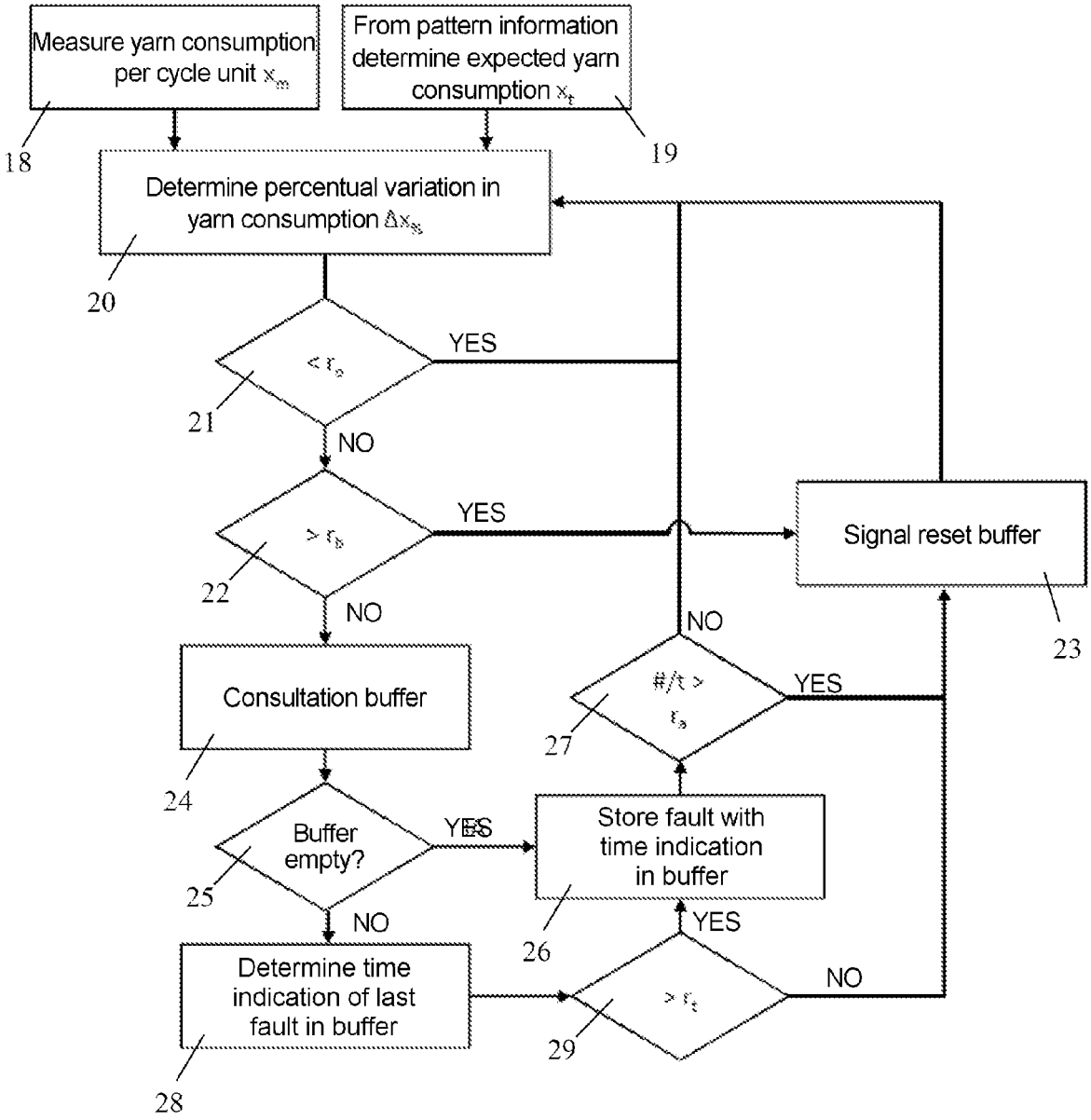
FIG. 5 is represented a flow chart which illustrates a method according to the present disclosure.

In FIG. 5 is illustrated in a flow chart how, in such a weaving machine (1), abnormal variations in pile-forming can be detected.

For each cycle unit of one or more weft insertion cycles, it is examined by the central control unit (10), for each pile-warp yarn (7), whether this pile-warp yarn (7) is interlaced in a figure-forming manner or is incorporated in a non-figure-forming manner. When the pile-warp yarn (7) is interlaced in a figure-forming manner, this flow chart can be followed for this pile-warp yarn (7).

For this pile-warp yarn (7), there is here determined by the central control unit (10), on the basis of the pattern information of the predefined weave pattern, the expected pile-warp yarn consumption $x_t$ (19). This can be realized, for example, on the basis of measurement values in respect of test measurements or earlier measurements for comparable pile-forming during a cycle unit, or based on computations, comparable with existing computations for stock management. Preferably, a start is made with theoretically determined values, which then, over time, are modified on the basis of measurements.

The central control unit (10) forms with the herein stored pattern information a reference system for determining on the basis of the predefined weave pattern, for each cycle unit, whether the pile-warp yarn (7) is interlaced in a figure-forming manner, and for determining the expected pile-warp yarn consumption $x_t$ for this pile-warp yarn (7).

With the aid of the speed of the motor (8) and the diameter of the drive roller (11), the local control unit (9) is able to determine the pile-warp yarn consumption $x_m$ (18) of the pile-warp yarn (7) which is fed with this drive roller (11) to the weaving device (5). The central control unit (10) sends, for each cycle unit, a pulse to the local control unit (9) to start the measurement (18) of the pile-warp yarn consumption $x_m$ per cycle unit, this, for example, upon the beat-up of the reed (so that a weft insertion cycle is used as the cycle unit), or at the moment that the Jacquard (6) makes its selection (so that a Jacquard cycle is used as the cycle unit and thus the method is performed for every 2 weft insertion cycles).

The local control unit (9) and the motor (8) here form a measuring system for measuring the pile-warp yarn consumption $x_m$ of the pile-warp yarn (7) which is fed with the corresponding drive roller (11).

Even when the pile-warp yarn (7), during this cycle unit, is incorporated in a non-figure-forming manner, this pile-warp yarn consumption is able to be measured, in which case, however, no further detection according to the flow chart is carried out on this measurement. As further indicated, this measurement can then, together with the measurements of the pile-warp yarn consumption $x_m$ in pile-forming, be used, for example, for stock management.

The local control unit (9) can forward the pile-warp yarn consumption $x_m$, measured per cycle unit, of a pile-forming pile-warp yarn (7) to the central control unit (10) of the weaving machine (1), this together with its ID, where the percentual variation $\Delta x_{\%}$ of the measured pile-warp yarn consumption $x_m$ relative to the expected pile-warp yarn consumption $x_t$ is determined (20).

Another possibility is that the local control unit (9) gets sent the expected pile-warp yarn consumption $x_t$ from the central control unit (10) and itself determines this percentual variation $\Delta x_{\%}$ (20).

The further detection can then be executed analogously, i.e. either by the local control unit (9) or by the central control unit (10). This local control unit (9) and/or this central control unit (10) then here form the computing system for comparing, for each cycle unit, the measured pile-warp yarn consumption $x_m$ with the expected pile-warp yarn consumption $x_t$, and for, on the basis of this comparison, detecting abnormal variations.

It is firstly examined whether the percentual variation $\Delta x_{\%}$ lies below a lowermost reference value $r_o$ (21).

Figure 3:
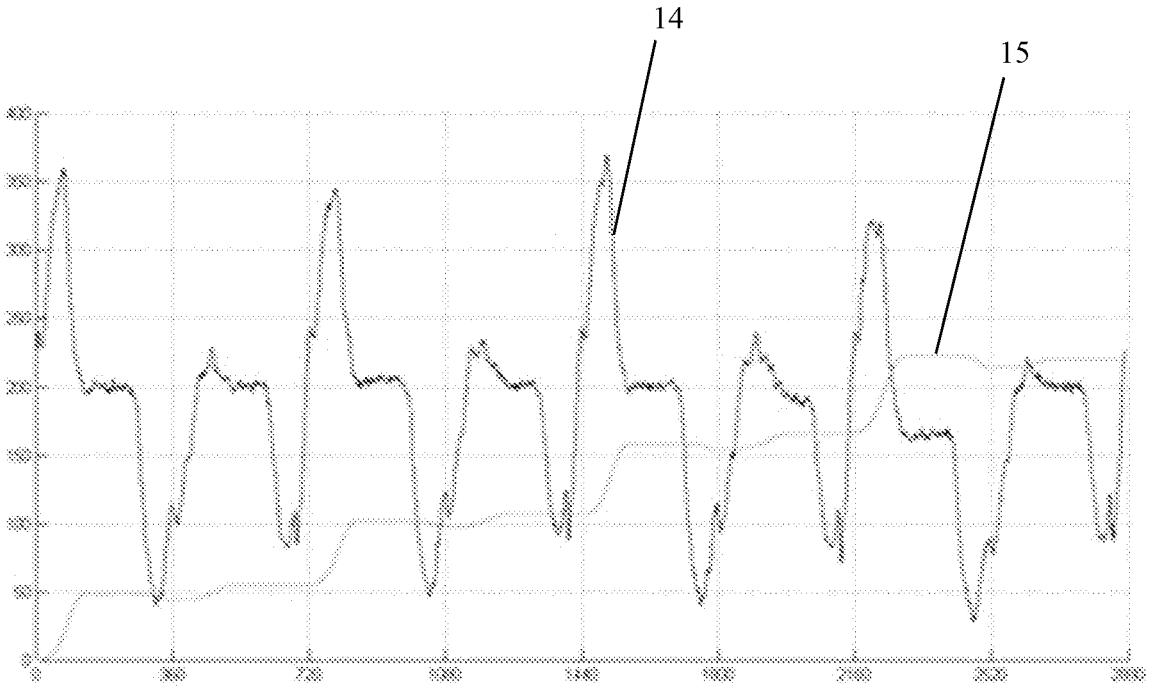
FIG. 3 a graph of the pile-warp yarn tension and the pile-warp yarn consumption in pile-forming over time is represented.
Figure 4:
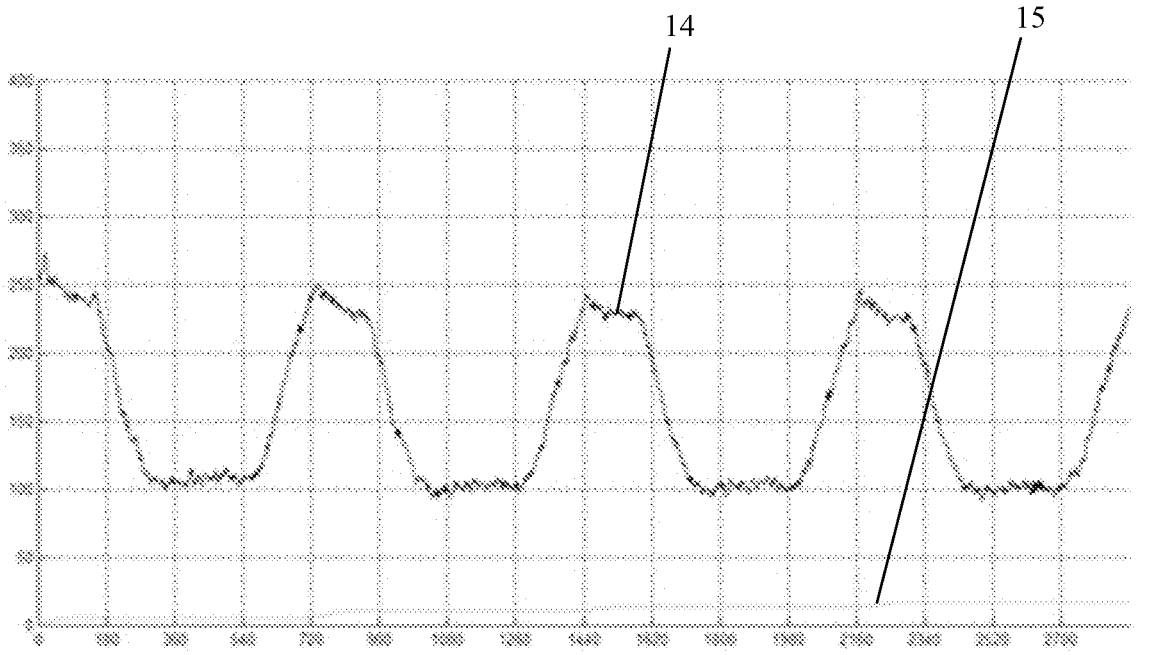
FIG. 4 a graph of the pile-warp yarn tension and the pile-warp yarn consumption in non-figure-forming incorporating over time is represented.

Depending on the type of pile-forming, pile-warp yarn consumption can vary strongly. In FIGS. 3 and 4 can be seen measurements of pile-warp yarn tension (14) (in g) and pile-warp yarn consumption (15) (in mm), in the case of a maximum pile-forming (FIG. 3) and when this pile-warp yarn is incorporated in a non-figure-forming manner (FIG. 4). In the pile-forming, the average pile-warp yarn consumption is here 55 mm per weft insertion cycle, whilst this, is only 4.2 mm in the case of incorporation in a non-figure-forming manner. In the case of differing pile formations, the pile-warp yarn consumption (15) will lie somewhere between these two values.

In such measurements, variations of about 3% are observed between predicted consumption with a view to stock management, and effective consumption. As the lowermost reference value $r_o$, 5% to 10%, for example, can initially be chosen, depending on the type of pile-forming. Over time, this reference value $r_o$ can be modified for example, as a function of the determined percentual variations $\Delta x_{\%}$, to about 4% to 8%, depending on the type of pile-forming.

If the percentual variation $\Delta x_{\%}$ lies below the lowermost reference value $r_o$, then there is no abnormal variation and the detection process can be repeated.

If the percentual variation $\Delta x_{\%}$ lies above the lowermost reference value $r_o$ or coincides with this lowermost reference value $r_o$, it is further examined whether this percentual variation $\Delta x_{\%}$ lies above an uppermost reference value $r_b$ (22).

This uppermost reference value $r_b$, just like the lowermost reference value $r_o$, can be determined and/or modified on the basis of earlier measurements and in dependence on the type of pile-forming.

As the lowermost reference value $r_b$, 10% to 25%, for example, can initially be chosen, depending on the type of pile-forming. Over time, this reference value $r_b$, as a function of the determined percentual variations $\Delta x_{\%}$, can be modified, for example, to about 8% a 20%, depending on the type of pile-forming.

If the percentual variation $\Delta x_{\%}$ lies above the uppermost reference value $r_o$, then this indicates abnormal variation as a result of a major fault. A signal can then be generated (23), whereupon the fault can be further defined and repaired.

To this end, the yarn tensioning system (3) from FIG. 2*b* is provided, for example, with LEDs or lamps (13) as signalling means. Alternatively or additionally, it is also possible, for example, to signal abnormal variations via the Jacquard of the weaving machine, for example, or via a computer, or via smart wristbands, etc.

Further alternatively or additionally, the weaving machine can, for example, be stopped and hereupon, for example, be placed in a specific position in which a possible fault is easier to rectify. Thus all heddles, for example, can be let downwards and the heddle which has problems can be pulled upwards (or vice versa). Instead of simply pulling the heddle which has problems upwards (assuming that this heddle can no longer move), it can also be opted to pull upwards all heddles whereof the pile-warp yarns pass through the same dent as the pile-warp yarn which passes through the afflicted heddle.

Once the fault has been repaired and the weaving continued, the detection process can also be repeated.

If the percentual variation $\Delta x_{\%}$ lies not above, but below the uppermost reference value $r_b$, or coincides herewith, this indicates minor faults, which typically point to a sub-optimal weaving process. These minor faults will be regarded as normal or as abnormal, depending on the frequency of occurrence thereof. For the determination thereof, these can be saved in a buffer.

If the percentual variation $\Delta x_{\%}$ lies not above, but below the uppermost reference value $r_b$, or coincides herewith, then this buffer is firstly consulted (24).

It is examined whether this buffer is empty (25).

If this buffer is empty, then the fault, with a time indication thereof, is saved in the buffer (26).

If this buffer is not empty, then the time indication is determined by the last fault which was saved in the buffer (28).

If this time indication is less long ago than a defined reference time $r_t$, then this is regarded as abnormal and a signal is generated (23), whereupon the fault can be further defined and repaired, as already described above. The weaving process, for example, can herein be optimized. The buffer is afterwards emptied.

If this time indication is longer ago than the defined reference time $r_t$, then this is regarded as possibly normal and the fault, with a time indication thereof, is saved in the buffer (26).

Once a fault has been saved in the buffer (26), it is further examined whether the number of faults in this buffer lies above a defined reference value $r_a$ (27). If this is not the case, the detection process can straightaway be repeated.

If the number of faults in the buffer lies above this reference value $r_a$, then this is regarded as abnormal and a signal is generated (23), whereupon the fault can be further defined and repaired, as already described above. The weaving process, for example, can herein be optimized. The buffer is afterwards emptied.

When the described detection process is executed in the central control unit (10), then this central control unit (10) can define the reference values on the basis of the pattern information and where necessary, after a certain time, modify these on the basis of the determined percentual variations $\Delta x_{\%}$.

When the described detection process is executed in the local control unit (9), then this local control unit (9) can receive reference values from the central control unit (10) and possibly, after a certain time, modify these on the basis of the determined percentual variations $\Delta x_{\%}$.

The determined percentual variations $\Delta x_{\%}$ can also be used to, over time, modify the determination of the expected pile-warp yarn consumption $x_t$.

The measurement values of the pile-warp yarn consumption $x_m$ measured per cycle unit can further also be stored and summated in order to determine the total pile-warp yarn consumption and thus do yarn stock management. These data can also be used to follow the consumption over the creel. With these data, a 3D overview can also, for example, be made of the consumption of the creel. There can also be signalled to an operator which bobbin has to be replaced, and the operator could signal that the bobbin has been replaced, whereby the consumption measurement can be restarted. For this, use can also be made, for example, of the aforementioned wristbands.

The invention claimed is:

1. Weaving machine, in which, in successive weft insertion cycles, at least one weft yarn is inserted between ground warp yarns so as to form together a ground fabric, and pile-warp yarns are interlaced according to a predefined weave pattern into the ground fabric in a figure-forming manner, or are incorporated in a non-figure-forming manner, comprising a yarn tensioning system for keeping at least one pile-warp yarn under tension and a detection device for detecting abnormal variations in pile-forming, wherein this detection device:

comprises a measuring system, for measuring pile-warp yarn consumption $x_m$ of the at least one pile-warp yarn per cycle unit of one or more weft insertion cycles;

comprises a reference system for determining on the basis of the predefined weave pattern, for each cycle unit, whether the at least one pile-warp yarn is interlaced in a figure-forming manner, and for determining the expected pile-warp yarn consumption $x_t$ for the at least one pile-warp yarn; and comprises a computing system, for comparing, for each cycle unit, the measured pile-warp yarn consumption $x_m$ with the expected pile-warp yarn consumption $x_t$ when the at least one pile-warp yarn, in this cycle unit, is interlaced in a figure-forming manner, and for, on the basis of this comparison, detecting abnormal variations;

wherein the yarn tensioning system comprises a local control unit, comprises a drive motor Wand comprises a drive roller, wherein the drive motor is controllable with the local control unit for the driving of the drive roller in order to feed the at least one pile-warp yarn and keep it under tension, and wherein the measuring system is provided to measure the pile-warp yarn consumption $x_m$ with the aid of the drive motor and the local control unit, wherein the drive motor Wand the local control unit, for this purpose, form part of the measuring system.

2. Weaving machine according to claim 1, wherein this weaving machine comprises a central control unit for controlling the weaving machine in order to insert, in successive weft insertion cycles, at least one weft yarn between ground warp yarns so as together to form a ground fabric, and to interlace pile-warp yarns according to a predefined weave pattern into the ground fabric in a figure-forming manner, or to incorporate them in a non-figure-forming manner, and wherein this weaving machine comprises communication means for communicating between the central control unit and the local control unit whether the at least one pile-warp yarn is interlaced in a figure-forming manner, wherein the reference system makes use of these communication means to determine the expected pile-warp yarn consumption for the at least one pile-warp yarn.

3. Weaving machine according to claim 2, wherein the detection device comprises a storage system for storing abnormal variations and the time of occurrence of these abnormal variations.

4. Method for detecting abnormal variations in pile-forming in a weaving machine, in which, in successive weft insertion cycles, at least one weft yarn is inserted between ground warp yarns so as to form together a ground fabric, and pile-warp yarns are interlaced according to a predefined weave pattern into the ground fabric in a figure-forming manner, or are incorporated in a non-figure-forming manner, wherein this method, for each cycle unit of one or more weft insertion cycles, comprises the following steps:

keeping at least one pile-warp yarn under tension;

measuring pile-warp yarn consumption $x_m$ of the at least one pile-warp yarn;

determining on the basis of the predefined weave pattern whether the at least one pile-warp yarn is interlaced in a figure-forming manner, and determining the expected pile-warp yarn consumption $x_t$ for the at least one pile-warp yarn; and comparing the measured pile-warp yarn consumption $x_m$ with the expected pile-warp yarn consumption $x_t$, when the at least one pile-warp yarn is interlaced in a figure-forming manner, and detecting, on the basis of this comparison, abnormal variations;

wherein the weaving machine is a weaving machine according to Claim 1, in which the pile-warp yarn is kept under tension with the aid of the drive motor and the local control unit, and wherein the pile-warp yarn consumption is measured with the aid of the drive motor and the local control unit.

5. Method according to claim 4, wherein, in step d, the percentual variation $\Delta x$ % of the measured pile-warp yarn consumption $x_m$ relative to the expected pile-warp yarn consumption $x_t$ is determined, and wherein, when this percentual variation $\Delta x$ % exceeds an uppermost reference value $r_b$, a signal is generated, and possibly the weaving machine is stopped in order to repair a fault.

6. Method according to claim 5, wherein, in step d, when the percentual variation $\Delta x$ % remains below the uppermost reference value $r_b$ and exceeds a lowermost reference value $r_0$, this percentual variation $\Delta x$ % is written as a small variation into a buffer, and when, for a specific time, a plurality of small variations are written into the buffer, a signal is generated and the buffer is emptied.

7. Method according to claim 5, wherein the uppermost reference value $r_b$, after a plurality of cycle units, is adapted as a function of the percentual variations $\Delta x$ % determined during the cycle units.

8. Local control unit of a weaving machine according to claim 1, wherein this local control unit is configured to control the detection device of this weaving machine according to a method for detecting abnormal variations in pile-forming in a weaving machine, in which, in successive weft insertion cycles, at least one weft yarn is inserted between ground warp yarns so as to form together a ground fabric, and pile-warp yarns are interlaced according to a predefined weave pattern into the ground fabric in a figure-forming manner, or are incorporated in a non-figure-forming manner, wherein the method, for each cycle unit of one or more weft insertion cycles, comprises:

keeping at least one pile-warp yarn under tension;

measuring pile-warp yarn consumption $x_m$ of the at least one pile-warp yarn;

determining on the basis of the predefined weave pattern whether the at least one pile-warp yarn is interlaced in a figure-forming manner, and determining the expected pile-warp yarn consumption $x_t$ for the at least one pile-warp yarn; and comparing the measured pile-warp yarn consumption $x_m$ with the expected pile-warp yarn consumption $x_t$, when the at least one pile-warp yarn is interlaced in a figure-forming manner, and detecting, on the basis of this comparison, abnormal variations, wherein the pile-warp yarn is kept under tension with the aid of the drive motor and the local control unit, and wherein the pile-warp yarn consumption is measured with the aid of the drive motor and the local control unit.

9. Central control unit of a weaving machine according to claim 3, wherein this central control unit is configured to control the detection device of this weaving machine according to a method for detecting abnormal variations in pile-forming in a weaving machine, in which, in successive weft insertion cycles, at least one weft yarn is inserted between ground warp yarns so as to form together a ground fabric, and pile-warp yarns are interlaced according to a predefined weave pattern into the ground fabric in a figure-forming manner, or are incorporated in a non-figure-forming manner, wherein the method, for each cycle unit of one or more weft insertion cycles, comprises:

keeping at least one pile-warp yarn under tension;

measuring pile-warp yarn consumption $x_m$ of the at least one pile-warp yarn;

determining on the basis of the predefined weave pattern whether the at least one pile-warp yarn is interlaced in a figure-forming manner, and determining the expected pile-warp yarn consumption $x_t$ for the at least one pile-warp yarn; and comparing the measured pile-warp yarn consumption $x_m$ with the expected pile-warp yarn consumption $x_t$, when the at least one pile-warp yarn is interlaced in a figure-forming manner, and detecting, on the basis of this comparison, abnormal variations, wherein the pile-warp yarn is kept under tension with the aid of the drive motor and the local control unit, and wherein the pile-warp yarn consumption is measured with the aid of the drive motor and the local control unit.

10. Computer program product, comprising computer-readable code, which, when this code is executed on a local control unit according to claim 8, this produces the result that the local control unit controls the detection device of the weaving machine according to a method for detecting abnormal variations in pile-forming in a weaving machine, in which, in successive weft insertion cycles, at least one weft yarn is inserted between ground warp yarns so as to form together a ground fabric, and pile-warp yarns are interlaced according to a predefined weave pattern into the ground fabric in a figure-forming manner, or are incorporated in a non-figure-forming manner, wherein the method, for each cycle unit of one or more weft insertion cycles, comprises:

keeping at least one pile-warp yarn under tension;

measuring pile-warp yarn consumption $x_m$ of the at least one pile-warp yarn;

determining on the basis of the predefined weave pattern whether the at least one pile-warp yarn is interlaced in a figure-forming manner, and determining the expected pile-warp yarn consumption $x_t$ for the at least one pile-warp yarn; and comparing the measured pile-warp yarn consumption $x_m$ with the expected pile-warp yarn consumption $x_t$, when the at least one pile-warp yarn is interlaced in a figure-forming manner, and detecting, on the basis of this comparison, abnormal variations, wherein the pile-warp yarn is kept under tension with the aid of the drive motor and the local control unit, and wherein the pile-warp yarn consumption is measured with the aid of the drive motor and the local control unit.

11. Computer program product, comprising computer-readable code, which, when this code is executed on a central control unit according to claim 9, this produces the result that the central control unit controls the detection device of the weaving machine according to a method for detecting abnormal variations in pile-forming in a weaving machine, in which, in successive weft insertion cycles, at least one weft yarn is inserted between ground warp yarns so as to form together a ground fabric, and pile-warp yarns are interlaced according to a predefined weave pattern into the ground fabric in a figure-forming manner, or are incorporated in a non-figure-forming manner, wherein the method, for each cycle unit of one or more weft insertion cycles, comprises:

keeping at least one pile-warp yarn under tension;

measuring pile-warp yarn consumption $x_m$ of the at least one pile-warp yarn;

determining on the basis of the predefined weave pattern whether the at least one pile-warp yarn is interlaced in a figure-forming manner, and determining the expected pile-warp yarn consumption $x_t$ for the at least one pile-warp yarn; and comparing the measured pile-warp yarn consumption $x_m$ with the expected pile-warp yarn consumption $x_t$, when the at least one pile-warp yarn is interlaced in a figure-forming manner, and detecting, on the basis of this comparison, abnormal variations, wherein the pile-warp yarn is kept under tension with the aid of the drive motor and the local control unit, and wherein the pile-warp yarn consumption is measured with the aid of the drive motor and the local control unit.

12. Non-transient machine-readable storage medium, which stores a computer program product according to claim 10.

* * * * *